US010039364B2

(12) United States Patent
Lee

(10) Patent No.: US 10,039,364 B2
(45) Date of Patent: Aug. 7, 2018

(54) ANTIPERSPIRANT-DEODORANT APPLICATOR

(71) Applicant: Randy S. Lee, Hurricane, UT (US)

(72) Inventor: Randy S. Lee, Hurricane, UT (US)

( * ) Notice: Subject to any disclaimer, the term of this patent is extended or adjusted under 35 U.S.C. 154(b) by 201 days.

(21) Appl. No.: 15/140,661

(22) Filed: Apr. 28, 2016

(65) Prior Publication Data

US 2017/0164716 A1 Jun. 15, 2017

Related U.S. Application Data

(60) Provisional application No. 62/266,104, filed on Dec. 11, 2015.

(51) Int. Cl.
*A45D 40/20* (2006.01)
*A45D 40/00* (2006.01)

(52) U.S. Cl.
CPC ..... *A45D 40/00* (2013.01); *A45D 40/20* (2013.01)

(58) Field of Classification Search
CPC ..... A45D 40/20; A45D 40/205
USPC ..... 401/88
See application file for complete search history.

(56) References Cited

U.S. PATENT DOCUMENTS 2,187,163 A 1/1940 Langer
2,390,921 A 1/1958 Clark
3,008,476 A 11/1961 Pepin
3,100,363 A * 8/1963 Staver ..... A47K 5/05 248/686
3,369,267 A 2/1968 Friedland
3,397,027 A 8/1968 Harrison
4,147,441 A 4/1979 Doyle
D289,858 S 5/1987 Duval
4,728,210 A * 3/1988 Barish ..... A45D 40/00 401/6
5,051,016 A 9/1991 Bengston
5,401,113 A 3/1995 Gueret
5,989,531 A 11/1999 Barr
6,325,565 B1 12/2001 Girardot
8,177,449 B2 5/2012 Bayly
8,403,584 B2 3/2013 Stange
8,827,582 B1 * 9/2014 Seymour ..... A45D 34/04 401/10
2013/0108351 A1 5/2013 Yeats
2013/0183077 A1 7/2013 Emery
2013/0251436 A1 * 9/2013 Morrow ..... A45D 34/00 401/6

* cited by examiner

*Primary Examiner* — Jennifer C Chiang
(74) *Attorney, Agent, or Firm* — Matthew M. Googe; Robinson IP Law, PLLC

(57) ABSTRACT

A personal hygiene antiperspirant-deodorant applicator is provided having: a cap portion including a handle projecting outwardly from the cap; a base portion; and a solid balm composition having an elliptical cross-section attached to the base portion. In a first configuration the base portion is in a press-fit engagement with the cap portion such that the solid balm composition is covered by the cap portion, and in a second configuration the base portion is reversed and in a press-fit engagement with the cap portion such that the solid balm composition is exposed and cap portion provides a handle for manipulating the applicator.

12 Claims, 9 Drawing Sheets

ANTIPERSPIRANT-DEODORANT APPLICATOR

CROSS-REFERENCE TO RELATED APPLICATION

This application claims priority to U.S. Patent Application Ser. No. 62/266,104 for an Intimate Personal Hygiene Antiperspirant-Deodorant Applicator, which was filed on Dec. 11, 2015, the contents of which are incorporated herein by reference in its entirety.

FIELD

This disclosure relates to the field of personal hygiene products. More particularly, the present disclosure relates to a portable personal antiperspirant or deodorant applicator.

BACKGROUND

Personal hygiene can be defined as a person keeping themselves clean and presentable such that they are well received by people in public places. There are many different aspects to personal hygiene, all of which are very important to the overall concept. The term hygiene focuses primarily upon the prevention of illness and the promotion of good health. As such, much of personal hygiene focuses on personal cleanliness including but not limited to regular bathing, washing hands after using restrooms, wearing clean clothing, and brushing teeth. A subset and extension of personal hygiene which does not focus on health but instead focuses on personal appearance is known as personal grooming. Personal grooming focuses primarily on personal appearance in public and may include but is not limited to combing hair, cutting hair, shaving, and using deodorants or perfumes. The use of deodorant is a practice which has become very common in the modern world, as having strong or odiferous body odor is generally considered to be unpleasant, often offensive, and indicative of overall poor personal hygiene.

Deodorant can be defined as any substance which is applied to the body in order to affect body odor. Body odor is caused by bacterial processes occurring with perspiration on certain areas of the body such as the armpits and the feet. Deodorants function primarily to eliminate odors and do so by way of specific chemical composition which may also be intended to impede or reduce bacterial growth wherever the deodorant is applied. A subtype of deodorant known as antiperspirants includes chemicals which serve to drastically reduce or stop the production of perspiration wherever the antiperspirant is applied. In many cases, an antiperspirant may be combined with a deodorant, thereby serving to eliminate any odors already present as well as reducing the chance of further odor by removing the moisture vital to the bacteria whose waste products are responsible for the odor. Deodorants and antiperspirants come in several different forms including sprays, solids, liquids, and powders.

These varying forms of deodorant and antiperspirant may be applied to the body in a number of different ways. Spray on deodorants and antiperspirants are typically applied via an aerosol can which allows them to be sprayed onto the body by a user. Liquid deodorants and antiperspirants can also be applied via a roll on applicator which functions very similarly to a ball point pen. Solid deodorants and antiperspirants are perhaps the most common in the modern world, and are typically applied via a plastic casing in which a solid mass of the deodorant or antiperspirant is stored. The solid mass is extruded outwards from the container via a screw rod and push plate type construction. This design is typically referred to as a stick of deodorant, and can be utilized for a long period of time as it has significant reserves of the deodorant or antiperspirant substance.

Bacteria grow and thrive in warm, moist areas of the body and consequently can produce malodor, skin rash, and discomfort. Malodor and perspiration are not exclusive to just the armpits of the body, but can also occur in the inguinal region, inframammary fold, and other body areas where excessive skin folds can be found or contacting opposing skin surfaces that shift and rub (as often seen with obese individuals). The accumulation of moisture and bacteria in these areas can often lead to intertrigo, a common dermatologic skin condition. An applicator that more specifically addresses these other intimate areas of the body for hygienic and or dermatologic purposes is highly desirable and needed.

All of the above described methods of applying deodorant and antiperspirant are well known within the art, and are known to be fairly effective. However, most of the above mentioned methods of applying deodorant and or antiperspirant suffer from two major flaws; their design is bulky and not customized for the more intimate areas of the body such as the inguinal area and the infra-mammary fold, and their balm formulations may not address the more delicate or sensitive skin composition that may be associated with some of those areas. As mentioned, current deodorant and or antiperspirant applicator motifs are bulky and indiscreet, thus not allowing for thorough application in the intimate skin folds and creases of the body. Considering this, it is an objective of the present invention to introduce a novel deodorant applicator which is tailored, useful, and far more efficient at applying deodorant and or antiperspirant to the intimate areas of the body. The present invention is streamlined and very compact such that it is extremely easy to use and is also highly portable. The present invention makes use of a simple friction fit style cap in order to cover a solid mass of deodorant and or antiperspirant; the solid mass can be exposed and the cap doubles as a handle to make application of the deodorant and or antiperspirant exceedingly easy for the user.

SUMMARY

The above and other needs are met by a portable personal hygiene antiperspirant-deodorant applicator. In a first aspect a personal hygiene antiperspirant-deodorant applicator is provided having: a cap portion including a hollow body having an open end with an elliptical cross-sectional area and a closed end formed of an elliptical dome and a handle projecting outwardly from the closed end of the hollow body, the handle attached to the dome at a first end of the handle and extending to a second end of the handle that is distal from the first end; a base portion formed of an elliptical flat member, an elliptical flat member including an outer edge, a wall formed around the outer edge of the elliptical, the wall portion extending upward from the elliptical flat member and having an outer diameter that is sized to form a press fit engagement with the open end of the hollow body; and a solid balm composition having an elliptical cross-section attached to the base portion, the solid balm including a top portion formed into an elliptical dome shaped to conform with the elliptical dome closed end of the hollow body. In a first configuration the base portion is in a press-fit engagement with the cap portion such that the solid balm composition is covered by the cap portion, and in a second configuration the base portion is reversed and in a press-fit engagement with the cap portion such that the solid balm composition is exposed and cap portion provides a handle for manipulating the applicator.

In one embodiment, the personal applicator further includes a balm protrusion extending from the elliptical flat member and into the solid balm composition to secure the solid balm composition to the base portion.

In another embodiment, the personal applicator further includes at least one finger grip portion formed in the base portion. In yet another embodiment, the finger grip portion includes a pair of opposing finger grip portions formed on opposite outside surfaces of the base portion.

In one embodiment, the outwardly projecting handle is flared such that a width of the handle is narrower at the first end of the handle than a width at the second end of the handle.

In another embodiment, the personal applicator further includes a latch formed in one of the cap portion and base portion for securing the cap portion to the base portion.

In yet another embodiment, the wall is tapered such that an upper end of the wall is narrower than a width of the wall at which the wall is joined to the elliptical flat member. In one embodiment, the wall further extends downward relative to the elliptical flat member to form a protruding lip below the elliptical flat member. In another embodiment, the wall is tapered such that a lower end of the wall is narrower than a width of the wall at which the wall is joined to the elliptical flat member.

In a second aspect, a personal hygiene antiperspirant-deodorant applicator is provided having: a cap portion including a hollow body having an open end with an elliptical cross-sectional area and a closed end formed of an elliptical dome and a handle projecting outwardly from the closed end of the hollow body, the handle attached to the dome at a first end of the handle and extending to a second end of the handle that is distal from the first end; a base portion formed of an elliptical flat member, an elliptical flat member including an outer edge, a wall formed around the outer edge of the elliptical, the wall portion extending upward from the elliptical flat member and having an outer diameter that is sized to form a press fit engagement with the open end of the hollow body, and a pair of opposing finger grip portions formed on opposite outside surfaces of the base portion; and a solid balm composition having an elliptical cross-section attached to the base portion, the solid balm including a top portion formed into an elliptical dome shaped to conform with the elliptical dome closed end of the hollow body. In a first configuration the base portion is in a press-fit engagement with the cap portion such that the solid balm composition is covered by the cap portion, and in a second configuration the base portion is reversed and in a press-fit engagement with the cap portion such that the solid balm composition is exposed and cap portion provides a handle for manipulating the applicator.

In one embodiment, the outwardly projecting handle is flared such that a width of the handle is narrower at the first end of the handle than a width at the second end of the handle.

In a third aspect, a personal hygiene antiperspirant-deodorant applicator is provided having: a cap portion including a hollow body having an open end with an elliptical cross-sectional area and a closed end formed of an elliptical dome and a handle projecting outwardly from the closed end of the hollow body, the handle attached to the dome at a first end of the handle and extending to a second end of the handle that is distal from the first end, the handle flared such that a width of the handle is narrower at the first end of the handle than a width at the second end of the handle; a base portion formed of an elliptical flat member, an elliptical flat member including an outer edge, a wall formed around the outer edge of the elliptical, the wall portion extending upward from the elliptical flat member and having an outer diameter that is sized to form a press fit engagement with the open end of the hollow body, and a pair of opposing finger grip portions formed on opposite outside surfaces of the base portion; and a solid balm composition having an elliptical cross-section attached to the base portion, the solid balm including a top portion formed into an elliptical dome shaped to conform with the elliptical dome closed end of the hollow body. In a first configuration the base portion is in a press-fit engagement with the cap portion such that the solid balm composition is covered by the cap portion, and in a second configuration the base portion is reversed and in a press-fit engagement with the cap portion such that the solid balm composition is exposed and cap portion provides a handle for manipulating the applicator.

BRIEF DESCRIPTION OF THE DRAWINGS

Further features, aspects, and advantages of the present disclosure will become better understood by reference to the following detailed description, appended claims, and accompanying figures, wherein elements are not to scale so as to more clearly show the details, wherein like reference numbers indicate like elements throughout the several views, and wherein:

DETAILED DESCRIPTION

Various terms used herein are intended to have particular meanings. Some of these terms are defined below for the purpose of clarity. The definitions given below are meant to cover all forms of the words being defined (e.g., singular, plural, present tense, past tense). If the definition of any term below diverges from the commonly understood and/or dictionary definition of such term, the definitions below control.

A personal hygiene antiperspirant-deodorant applicator 10 is provided that is specifically designed to be used to apply antiperspirant-deodorant or other balms to intimate areas of the body which are not currently considered with traditional deodorant-antiperspirant applicators. The present invention is very compact and streamline when compared to current deodorant applicators; its small size and ergonomic design allow it to more easily apply deodorant to intimate areas and skin folds of the body and also makes the present invention very portable. The applicator includes a cap 12, a base 14, and a solid balm 16 (FIG. 8) placed within the base 14.

Figure 1:
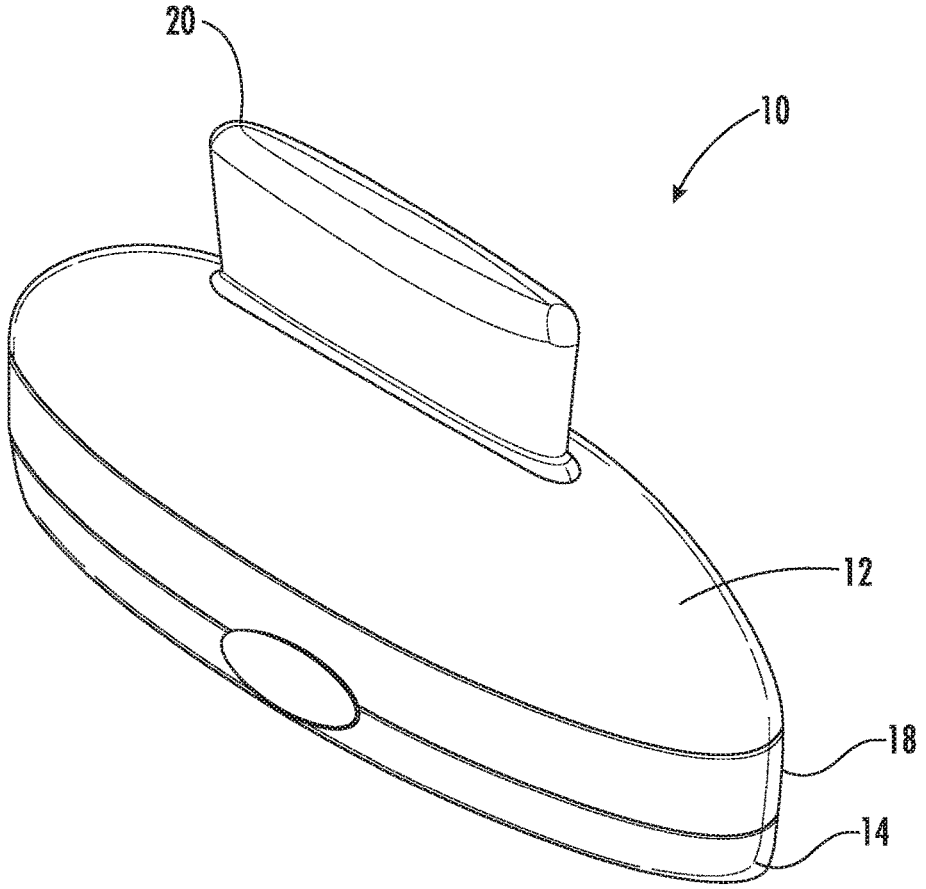
FIG. 1 shows perspective view of a deodorant applicator according to one embodiment of the present disclosure.
Figure 8:
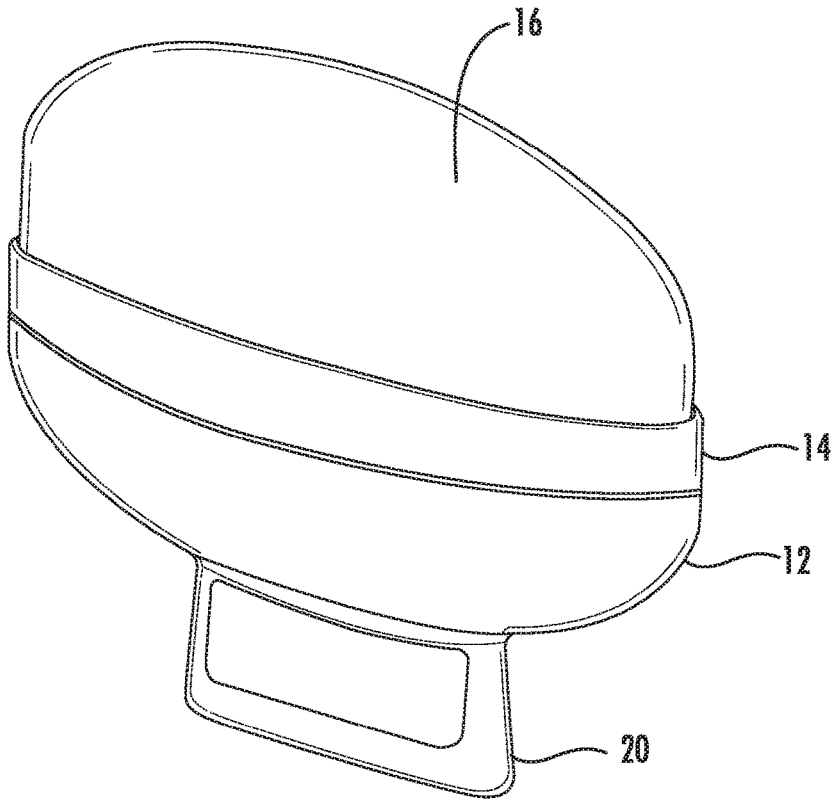
FIG. 8 illustrates a deodorant applicator in an application configuration according to one embodiment of the present disclosure.
Figure 9:
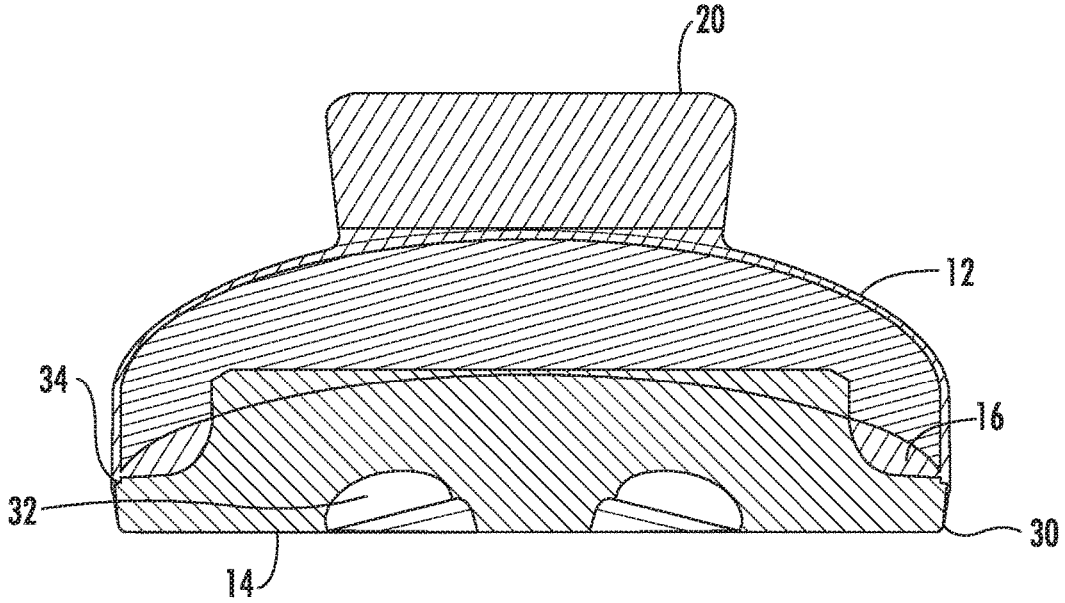
FIG. 9 is a cross-sectional side view of a deodorant applicator according to one embodiment of the present disclosure.

As shown in FIG. 1, the cap 12 includes a hollow body portion 18 and a handle 20 projecting from the hollow body portion 18 of the cap 12. The curved body of the cap is largely hollow and its primary purpose is to shield and store the solid balm when the present invention is not in use. The hollow body portion 18 includes a generally elliptical cross-sectional area which allows it to conform to the curvature of the solid balm which is intended to be stored within the cap. The hollow body portion 18 includes an open end at a first end of the hollow body 18 and a closed end opposite the open end, the closed end formed into an elliptical dome that conforms to a shape of the solid balm 16. The curvature and shape of the solid balm are illustrated in FIGS. 8 and 9.

Figure 2:
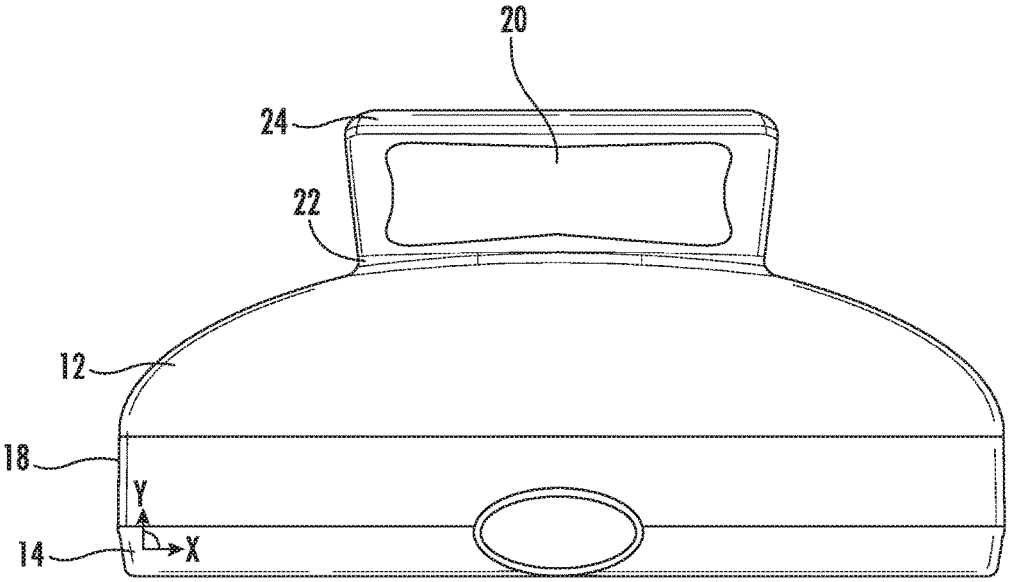
FIG. 2 shows a front view of a deodorant applicator according to one embodiment of the present disclosure.

Referring to FIG. 2, the handle 20 projects outwardly from the closed end of the hollow body 18 and is shaped to be grasped by a user's hand when a user desires to separate the cap 12 from the base 14 to expose the solid balm 16. The handle 20 further provides a grasp for the user when the user desires to manipulate the applicator 10 to apply the exposed solid balm 16 as discussed in greater detail below. The handle 20 is attached to the closed end of the body 18 at a first end 22 of the handle 20 and extends to a second end 24 that is distal from the first end 22. The handle 20 is preferably formed having an elliptical cross-sectional area, however it is also understood that other various shapes may be suitable. Further, to aid in grasping of the handle by a user, the handle 20 is substantially flared or tapered such that a width of the handle is narrower at the first end 22 of the handle 20 adjacent the hollow body 18 and wider at the second end 24 of the handle 20 that is distal from the hollow body 18.

Figure 4:
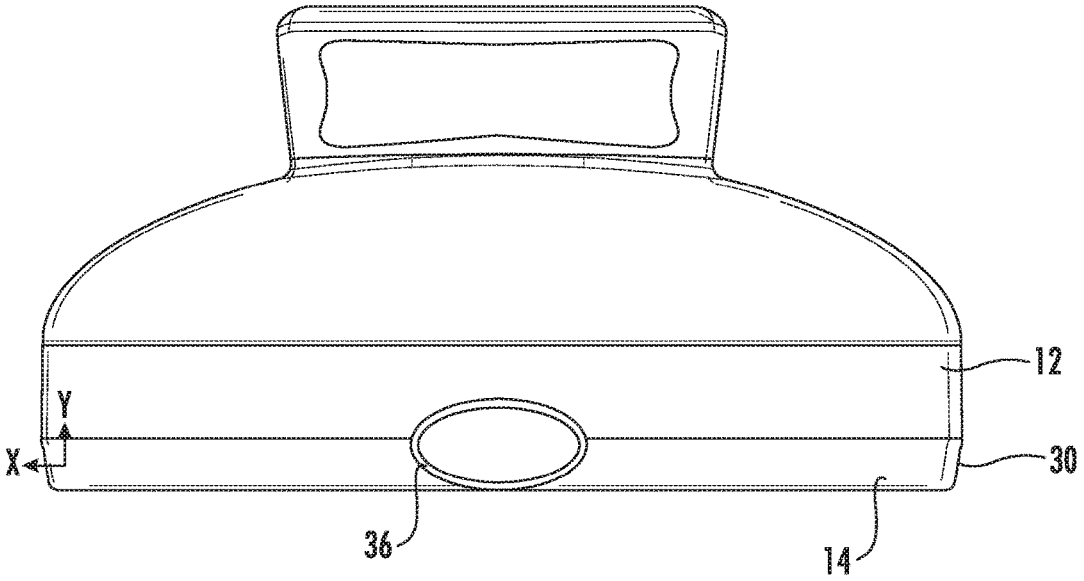
FIG. 4 shows a rear view of a deodorant applicator according to one embodiment of the present disclosure.
Figure 5:
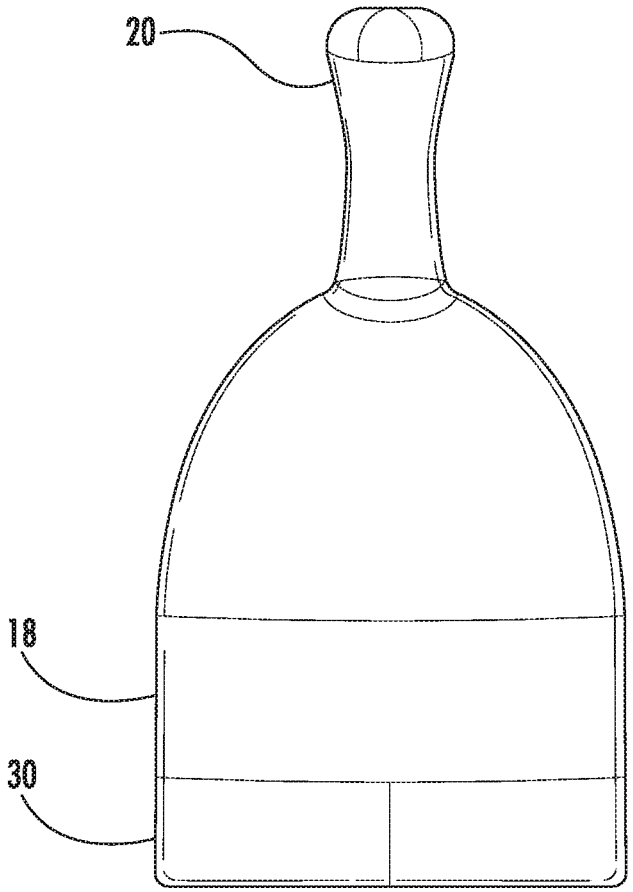
FIG. 5 shows a second side view of a deodorant applicator according to one embodiment of the present disclosure.
Figure 6:
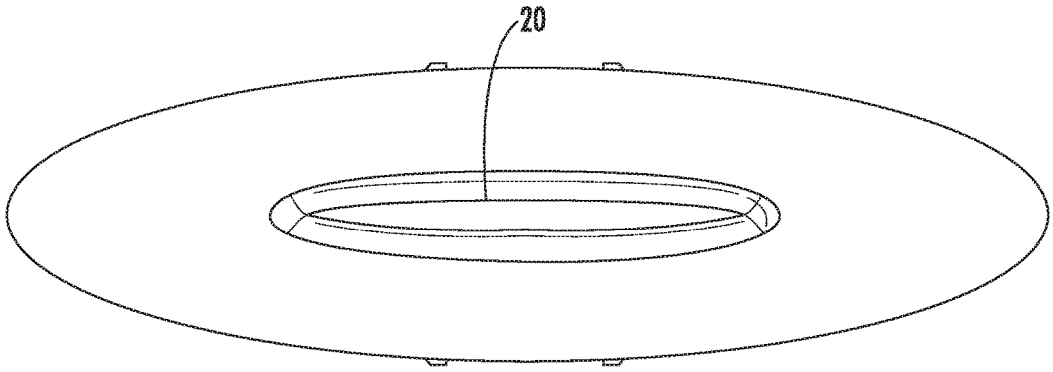
FIG. 6 shows a top view of a deodorant applicator according to one embodiment of the present disclosure.
Figure 7:
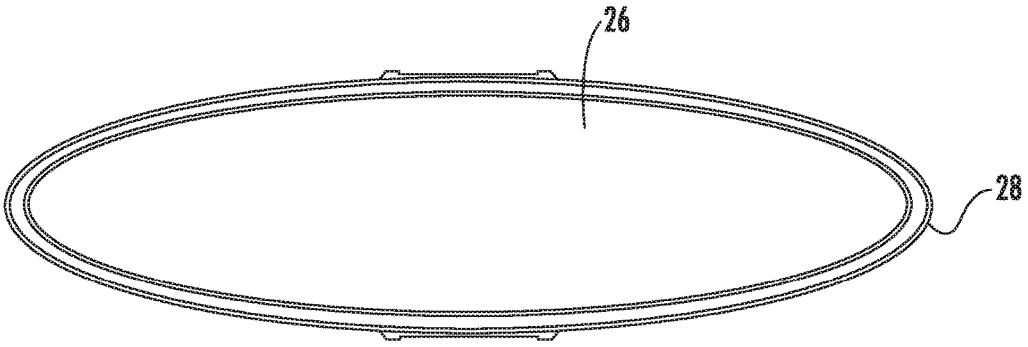
FIG. 7 shows a bottom view of a deodorant applicator according to one embodiment of the present disclosure.

Referring now to FIG. 7, the base 14 is formed of a flat member 26 that is preferably elliptical in shape. An outer edge 28 is formed around an outside of the flat member 26. Referring to FIG. 4, a wall portion 30 extends upwardly from the flat member 26 to form a cavity within the upwardly extending wall portion 30 and elliptical flat member 26. One or more balm protrusions 32 (FIG. 9) are formed on the flat member 26 for engaging a solid balm placed within the cavity of the base 14 to secure the solid balm to the base 14. The balm protrusions 32 may be formed of multiple bumps or other like projects that are configured to extend at least partially into a solid balm. Alternatively, balm protrusions 32 may be formed on an inward surface of the wall portion 30 such that the protrusions engage sides of a solid balm placed on the base 14.

Figure 3:
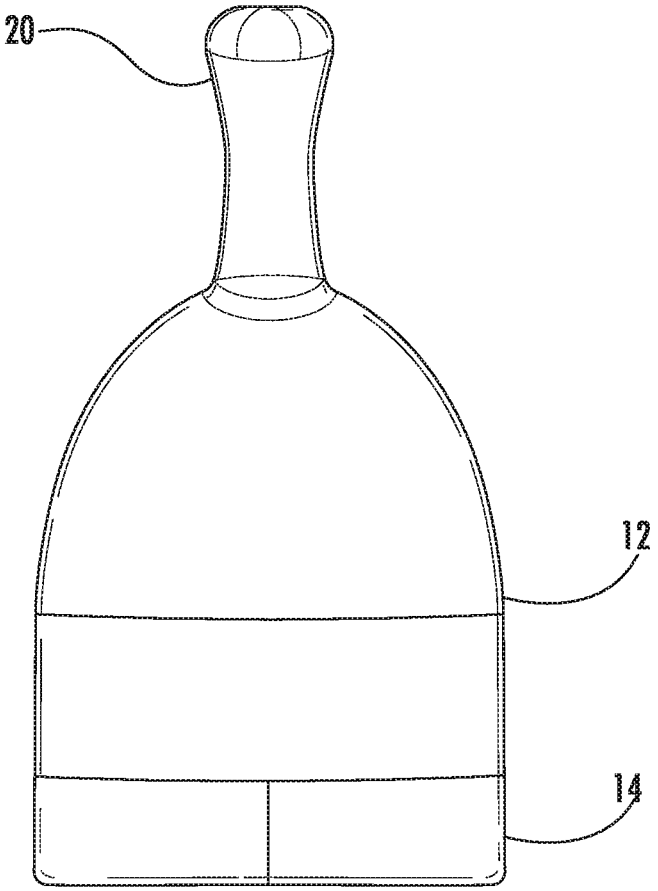
FIG. 3 shows a first side view of a deodorant applicator according to one embodiment of the present disclosure.

As shown in FIG. 4, the upwardly extending wall portion 30 may be tapered such that the wall portion 30 extends both upwardly and outwardly from the base 14. A lip 34 (FIG. 9) may be formed around an upper edge of the wall portion 30. An outer diameter of the lip 34 is slightly smaller than an inner diameter of the open end of the hollow body 18 of the cap 12 such that the cap 12 and base 14 are secured to one another with a press fit engagement such that the cap and base are frictionally secured to one another. Alternatively, the lip 34 may be formed on an inner surface of the wall portion 30 such that the cap 12 engages an inner portion of the base 14 in a press fit engagement to frictionally maintain the cap and the base together. When the cap 12 is attached to the base 14, outside edges of the hollow body 18 of the cap 12 and the wall portion 30 of the base 14 are substantially flush such that a continuous surface is formed along an outside of the applicator (FIGS. 2 and 3). An outer surface of the wall portion 30 of the base 14 is shaped to frictionally engage the open end of the cap 12 such that the base 14 may be reversed and frictionally secured to the cap as discussed below, with the outer surface of the wall portion 30 being flush with the outer surface of the cap 12. As shown in FIG. 7, the wall portion 30 may further extend downward from the flat member 26 of the base 14 to form a lip protruding from a bottom of the base 14.

Referring to FIG. 2, at least one finger grip 36 is formed on an outside of the wall portion 30. The finger grip 36 is preferably elliptical in shape and includes an indentation shaped to conform to a shape of a user's fingertip. The indention is preferably formed as an elliptical depression as illustrated in FIG. 2. An identical finger grip 36 is preferably formed on an opposite side of the base 14 of the applicator 10 to allow a user to pinch the base 14 at the finger grips 36 when removing or inserting the base 14 with the cap 12. In one embodiment, the finger grips 36 may further comprise a latch or other mechanism for physically securing the base 14 and cap 12 together. The latch may be formed such that when a user squeezes or otherwise presses the finger grips 36 the latch releases the cap 12 from the base 14.

The base 14 and cap 12 of the applicator 10 are preferably formed of the same material. For example, the base 14 and cap 12 may be formed of a polymer or other plastic material. In other embodiments, all or portions of the base 14 and cap 12 may be formed of other suitable materials. The base and cap may be formed, for example, by injection molding or other like methods.

The solid balm includes a deodorant and or antiperspirant which is applied to the user's body. The solid balm may comprise virtually any solid form deodorant and or antiperspirant which is known to the art. Furthermore, the solid balm is attached to the base as mentioned above, and may be partially embedded within the cavity of the base. Placement of the solid balm within the cavity of the base works in conjunction with the balm protrusion to ensure that the solid balm is stable, and does not break free from the base. It is important to note that the solid balm is shaped such that it fits snugly within the cap. The general shape of the solid balm can be observed in FIG. 8. It is also important to note that the contemplated solid balm may comprise any additional chemical substances which have beneficial effects such as antimicrobial, anti-fungal, and anti-yeast substances which prevent the growth of various pathogens wherever the balm is applied to the user's body.

In operation, the applicator 10 is capable of being configured in both a stored configuration and an application configuration. In the stored configuration, the cap 12 is engaged with the base 14 such that the solid balm 16 is substantially covered by the cap 12. The cap 12 and base 14 form a flush surface around an outside of the applicator 10 making the applicator 10 substantially portable. Further, the applicator 10 may be placed in a bag or other enclosure without the solid balm 16 contacting any other objects within the enclosure. The cap 12 is frictionally held to the base 14 where the cap 12 engages an upper portion of the wall of the base 14. The applicator 10 may be converted from the stored configuration to the application configuration when a user desires to apply the solid balm 16 of the applicator 10 to one or more areas of the user's body. To convert to the application configuration, the user first removes the cap 12 from the base 14. The cap 12 is then inverted and pressed onto a lower portion of the base 14 such that the solid balm 16 is exposed on an upper end of the applicator 10. The inverted cap and base 14 are mounted together such that the two components are flush and such that the handle 20 is located beneath the base 14 and exposed solid balm 16.

The applicator 10 advantageously provides a portable and compact means of applying a solid balm such as a deodorant or antiperspirant on a user. The applicator 10 provides a compact configuration that protects the balm during transport and storage, and further provides a handle and means of applying the balm when the cap is removed from the applicator. The compact applicator 10 makes application of the balm easy for a user, particularly on parts of the body that may be hard to reach or otherwise require manipulation of the applicator. Finally, the applicator 10 is relatively simple in construction, and provides that the base and cap are readily secured to one another to prevent losing either the cap or the base during storage, transportation, and use of the applicator 10.

The foregoing description of preferred embodiments of the present disclosure has been presented for purposes of illustration and description. The described preferred embodiments are not intended to be exhaustive or to limit the scope of the disclosure to the precise form(s) disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the concepts revealed in the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

What is claimed is:

1. A personal hygiene antiperspirant-deodorant applicator comprising:

a cap portion including a hollow body having an open end with an elliptical cross-sectional area and a closed end formed of an elliptical dome and a handle projecting outwardly from the closed end of the hollow body, the handle attached to the dome at a first end of the handle and extending to a second end of the handle that is distal from the first end;

a base portion formed of an elliptical flat member, an elliptical flat member including an outer edge, a wall formed around the outer edge of the elliptical, the wall portion extending upward from the elliptical flat member and having an outer diameter that is sized to form a press fit engagement with the open end of the hollow body; and a solid balm composition having an elliptical cross-section attached to the base portion, the solid balm including a top portion formed into an elliptical dome shaped to conform with the elliptical dome closed end of the hollow body;

wherein in a first configuration the base portion is in a press-fit engagement with the cap portion such that the solid balm composition is covered by the cap portion, and in a second configuration the base portion is reversed and in a press-fit engagement with the cap portion such that the solid balm composition is exposed and cap portion provides a handle for manipulating the applicator.

2. The personal applicator of claim 1, wherein the base portion further comprises a balm protrusion extending from the elliptical flat member and into the solid balm composition to secure the solid balm composition to the base portion.

3. The personal applicator of claim 1, further comprising at least one finger grip portion formed in the base portion.

4. The personal applicator of claim 3, wherein the finger grip portion includes a pair of opposing finger grip portions formed on opposite outside surfaces of the base portion.

5. The personal applicator of claim 1, wherein the outwardly projecting handle is flared such that a width of the handle is narrower at the first end of the handle than a width at the second end of the handle.

6. The personal applicator of claim 1, further comprising a latch formed in one of the cap portion and base portion for securing the cap portion to the base portion.

7. The personal applicator of claim 1, wherein the wall is tapered such that an upper end of the wall is narrower than a width of the wall at which the wall is joined to the elliptical flat member.

8. The personal applicator of claim 1, wherein the wall further extends downward relative to the elliptical flat member to form a protruding lip below the elliptical flat member.

9. The personal application of claim 8, wherein the wall is tapered such that a lower end of the wall is narrower than a width of the wall at which the wall is joined to the elliptical flat member.

10. A personal hygiene antiperspirant-deodorant applicator comprising:

a cap portion including a hollow body having an open end with an elliptical cross-sectional area and a closed end formed of an elliptical dome and a handle projecting outwardly from the closed end of the hollow body, the handle attached to the dome at a first end of the handle and extending to a second end of the handle that is distal from the first end;

a base portion formed of an elliptical flat member, an elliptical flat member including an outer edge, a wall formed around the outer edge of the elliptical, the wall portion extending upward from the elliptical flat member and having an outer diameter that is sized to form a press fit engagement with the open end of the hollow body, and a pair of opposing finger grip portions formed on opposite outside surfaces of the base portion; and a solid balm composition having an elliptical cross-section attached to the base portion, the solid balm including a top portion formed into an elliptical dome shaped to conform with the elliptical dome closed end of the hollow body;

wherein in a first configuration the base portion is in a press-fit engagement with the cap portion such that the solid balm composition is covered by the cap portion, and in a second configuration the base portion is reversed and in a press-fit engagement with the cap portion such that the solid balm composition is exposed and cap portion provides a handle for manipulating the applicator.

11. The personal applicator of claim 10, wherein the outwardly projecting handle is flared such that a width of the handle is narrower at the first end of the handle than a width at the second end of the handle.

12. A personal hygiene antiperspirant-deodorant applicator comprising:

a cap portion including a hollow body having an open end with an elliptical cross-sectional area and a closed end formed of an elliptical dome and a handle projecting outwardly from the closed end of the hollow body, the handle attached to the dome at a first end of the handle and extending to a second end of the handle that is distal from the first end, the handle flared such that a width of the handle is narrower at the first end of the handle than a width at the second end of the handle;

a base portion formed of an elliptical flat member, an elliptical flat member including an outer edge, a wall formed around the outer edge of the elliptical, the wall portion extending upward from the elliptical flat member and having an outer diameter that is sized to form a press fit engagement with the open end of the hollow body, and a pair of opposing finger grip portions formed on opposite outside surfaces of the base portion; and a solid balm composition having an elliptical cross-section attached to the base portion, the solid balm including a top portion formed into an elliptical dome shaped to conform with the elliptical dome closed end of the hollow body;

wherein in a first configuration the base portion is in a press-fit engagement with the cap portion such that the solid balm composition is covered by the cap portion, and in a second configuration the base portion is reversed and in a press-fit engagement with the cap portion such that the solid balm composition is exposed and cap portion provides a handle for manipulating the applicator.

* * * * *